US005358154A

United States Patent [19]

Halm

[11] Patent Number: 5,358,154

[45] Date of Patent: Oct. 25, 1994

[54] ONE-HAND-OPERABLE CONTAINER CLOSURE

[75] Inventor: Hans Halm, Herne, Fed. Rep. of Germany

[73] Assignee: Georg Menshen GmbH & Co. KG, Finnentrop, Fed. Rep. of Germany

[21] Appl. No.: 95,594

[22] Filed: Jul. 26, 1993

[30] Foreign Application Priority Data

Jul. 28, 1992 [EP] European Pat. Off. ..... 92112821

[51] Int. Cl.[5] ..... B65D 47/08

[52] U.S. Cl. ..... 222/536; 222/529; 222/563

[58] Field of Search ..... 222/528–537, 222/546, 563, 498

[56] References Cited

U.S. PATENT DOCUMENTS

| | | | |
|---|---|---|---|
| 1,949,058 | 2/1934 | Leguillon | 222/529 |
| 2,638,613 | 5/1953 | Gunther | 222/563 X |
| 2,804,242 | 8/1957 | Borah | 222/478 |
| 2,893,612 | 7/1959 | Akers | 222/536 |
| 3,260,425 | 7/1966 | Moran | 222/563 X |
| 3,366,285 | 1/1968 | Scislowicz | 222/529 X |

FOREIGN PATENT DOCUMENTS

| | | | |
|---|---|---|---|
| 376186 | 10/1984 | Austria . | |
| 24272 | 2/1982 | Fed. Rep. of Germany . | |
| 3522227 | 1/1987 | Fed. Rep. of Germany | 222/528 |
| 15673 | 3/1989 | Fed. Rep. of Germany . | |
| 2510520 | 2/1983 | France . | |
| WO81/00995 | 4/1981 | PCT Int'l Appl. . | |
| 385351 | 11/1961 | Switzerland . | |
| 865989 | 4/1961 | United Kingdom . | |

*Primary Examiner*—Kevin P. Shaver

*Attorney, Agent, or Firm*—Griffin Butler Whisenhunt & Kurtossy

[57] ABSTRACT

A closure includes a capping part (1), which is attachable to a container, in which a form-stable floor wall (9) has a sealing apparatus (11) with a sealing cone (13) is held to the rest of the capping part by means of a flexible wall area so that the sealing cone can be brought into and out of a sealing engagement relationship with a mouth opening (5) of the container. Measures are provided, for example in the form of inversions of a flexible wall area (12), to hold the sealing apparatus in end positions corresponding to open and closed positions of the sealing apparatus. In the end positions the sealing apparatus (11) can be moved by hand via an integral hand-manipulation portion (15). A pour spout (16) can be formed on the flexible wall area (12) so that it experiences a swinging upon movement of the sealing apparatus (11) between the closing and opening position corresponding to the respective positions of the flexible wall area.

7 Claims, 5 Drawing Sheets

ONE-HAND-OPERABLE CONTAINER CLOSURE

BACKGROUND OF THE INVENTION

This invention concerns a closure for a container, receiver, or the like. As used herein, the word "container" includes any type of receptacle or receiver.

The invention particularly concerns a one piece closure of resinous plastic which can be operated with one hand to close containers of fluid and pasty materials.

One-hand-operable tipping-lever closures are well known (see WO 81/00995) in which structurally-separate tipping (or pivotal) levers are held on a capping part to be pivotal in a snap-like manner. In one position such a tipping lever closes a passage opening in the capping part while in another position the lever opens the passage opening so that a fluid flow from a container's interior to outside atmosphere is allowed. A substantial disadvantage of this type of closure is the necessity of producing a plurality of separate parts which must be assembled in a specialized assembling procedure. It is also known (German Gebrauchsmuster DE-V-80 24 272) to attach a tipping lever as one piece with a capping part via a film-like hinge, with which part of a flow path to the outside, through a hose-like, bendable, wall extending between the tipping lever and the interior of the container is sealed. Although this closure is made as one piece, difficulties still arise in trying to reliably seal a passage of the tipping lever in a closed position, and also the hose-like wall has limitations relative to a choice of an open position for the tipping lever in that it is consistantly oriented in the direction of a middle axis of the closure which, for manipulation of particular fluids, or medians, is undesirable. It is further known (German DE-U-88 15 673) to arrange a tipping lever of a multiple-part closure to be pivotal in a plane substantially radial to a middle axis so that contents of a container can be poured out from a side thereof in the manner of a watering can. In addition to the disadvantage that manufacturing such a closure is difficult, other problems arise when this closure is to be manipulated with one hand. Finally, a one piece, one-hand-operable, closure is known (AT-PS-376 186) in which a sealing cone and a pour spout are formed on a bendable floor wall of a capping part for engaging a mouth opening of a container such that an exterior force can be applied to the sealing cone and the pour spout to temporarily move the sealing cone out of a sealing relationship with the mouth opening of the container against a return force of the floor wall so that communication of the container interior with a passage of the pour spout comes into being. The open position of the pour spout is, therefore, only held so long as the outside force is applied, which, with regard to manipulation of the closure, can cause problems when the container contents is to be dispensed, for example, on difficult to reach areas and/or where hygiene must be taken into consideration. Further, the pour spout tends to substantially stay in the open position as well as in the closed position, when it is moved there, because the flexibility of the floor wall allows only a small pivoting of the pour spout in response to force applied thereto, otherwise a firm seating of the capping part on the container would be endangered.

It is an object of the invention to provide a one piece, one-hand container of resinous plastic for closing fluid or paste containers which can be economically produced and which provides improved functionality as well as comfort in operation.

SUMMARY

According to principles of this invention, a sealing apparatus, which preferably includes a sealing cone or cylinder for engaging a rim forming a mouth opening of a container, is movable, due to a flexible, of reduced-thickness, wall area, relative to the rest of an otherwise form-stable floor wall of a capping part, in response to an exterior force without somehow detracting from a secure seating of a capping part of the container. Measures are also provided for maintaining open and closed positions of the sealing element when no force is applied to the closure so that attention of an operator is demanded only during a time when the closure is changed from one position to the other. A particularly beneficial manufacturing-technology measure is brought about by this invention in that the flexible wall area has a prestressed membrane, or curtain, form which is invertible between two stable positions, corresponding to the open and closed positions of the sealing apparatus. Although the closure of this invention allows arrangements of the spout element at other desired appropriate positions with desired orientations relative to a closure main axis, in a further preferred embodiment of the invention the flexible wall area supports, or carries, the spout element. Hand manipulation is further simplified in that the spout element moves with the flexible wall area and, for example, swings from a vertical position to the side or laterally, so that the sealing apparatus is in the open position and the closure can then be handled in the same manner as a watering can. The sealing apparatus can, according to a further embodiment of the invention, be formed as one piece with a hand manipulatable area being optimized for efficient use and also offers a good visible advertisement carrier.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Although other appropriate means can be provided to attach a closure to a container at a mouth opening, for example, a threaded screw connection and, according to arrangement of the container as well as an end of the container defining the mouth opening, other configurations as well, the invention is described below to have a press fit, or snap fit, between a closure and an appropriately configured container-mouth end of the container.

Figure 1:
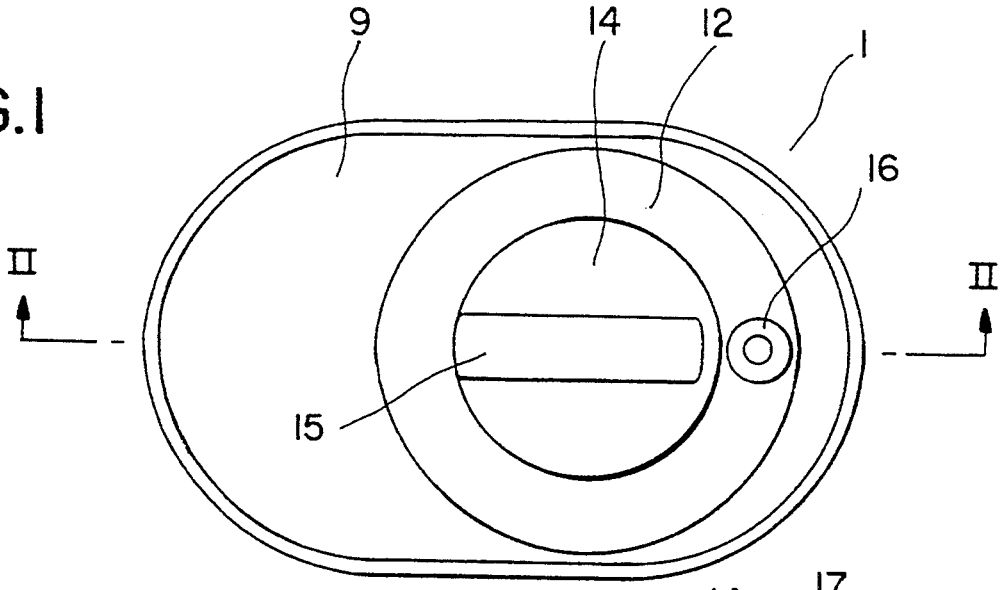
FIG. 1 is a top plan view of a closure according a first embodiment of the invention.
Figure 2A:
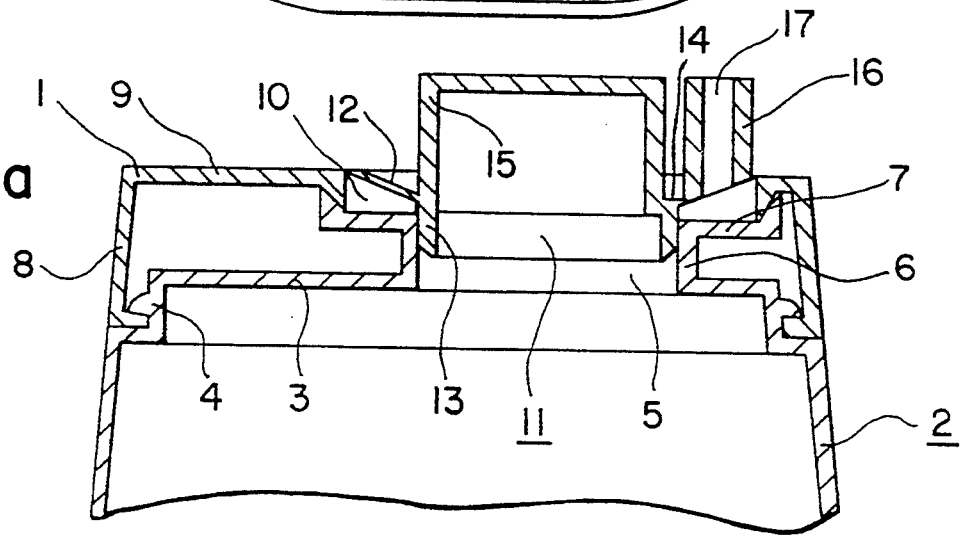
FIGS. 2*a* and 2*b* are cross-sections taken on line II—II in FIG. 1 which respectively represent the closure in a closed position and an open position, with only a fragment of a container being shown.
Figure 2B:
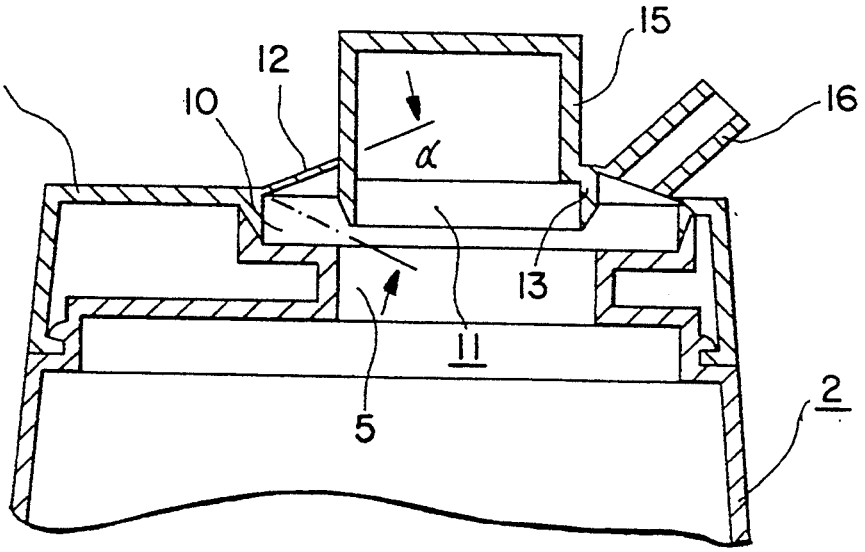

Reference is made to the first embodiment of the invention shown in FIGS. 1, 2*a* and 2*b*. A container identified generally by reference number 2 has a top-end, or closure, wall 3 which is connected to a side wall of the container 2 by means of a shoulder 4. A passage, or mouth opening 5 is formed in the end wall 3 which is defined and surrounded by a flange-like, axially-extending circumferential wall 6. An end of the circumferential wall 6 opposite the end wall 3 changes over to an extended wall area 7 which extends below a recess 10 in a floor wall 9 of a capping part 1 of the closure when the closure is attached to the container 2.

The capping part 1 represents a substantially form-stable (normally retains it shape) structural part with an outer wall portion 8 having a radially, inwardly, directed bead at its free, lower, end which makes snapping, seating engagement with a radially outwardly extending protrusion on the shoulder 4 of the container 2 in order to affix the capping part 1 to the container 2. The capping part 1 further includes the form-stable floor wall 9 in which a likewise, basically form-stable bowl shaped arrangement, or apparatus, 11 including a sealing cylinder, or cone, 13 which is held integral with a base wall 14. The dimensions of the sealing cone 13 are determined by dimensions of the mouth opening 5 of the container 2 so that the sealing cone 13 can come into sealing engagement to close the mouth opening 5.

According to the invention, the sealing apparatus 11 is attached to the floor wall 9 of the capping part 1 by a flexible, relatively-thin, wall area 12 which extends about the entire perimeter, or circumference, of the sealing apparatus 11. The flexible wall area 12 can hold the sealing apparatus 11 in two stable end positions relative to the rest of the capping part 1 because it is so constructed that it can be snapped from one end position to the other in an over-center manner if a predetermined outside force is applied to the sealing apparatus 11. This is achieved in that the flexible wall 12, in each end position achieves a hood, or cone, configuration so that in each end position it is not aligned with the adjacent floor wall 9 of the capping part 1.

In FIG. 2*a* the flexible wall area 12 is shown in a downward end position, that is, it is inverted in the direction of the container 2. In this end position the flexible wall area 12 is received in the recess 10 of the capping part 1 so that the sealing cone 13 sealingly engages in the mouth opening 5 of the container 2. In this position the flexible wall area 12 is in the form of a tapered, truncated, cone, having an outer surface which diverges from the container 2.

FIG. 2*b* depicts the flexible wall area 12 at its other end position wherein the sealing cone 13 is moved away from the sealing relationship with the circumferential wall forming the mouth opening 5 of the container 2. In this case the flexible wall area 12 lies in a diverging cone toward the outer surface of the container 2. In this position the flexible wall area 12 extends upwardly out of the recess 10 of the capping part 1 to place the closure in its preferred shape.

The outer cone-shaped surface of the flexible wall area 12 in the wall's end positions defines an angle $\alpha$. The size of $\alpha$ can vary very greatly and can, for example, be between 30° and 90°.

Further, at an appropriate eccentric position on the flexible wall area 12, a pouring element is formed which preferably is in the shape of a pipe-shaped pouring spout 16 with a bore 17. The bore 17 opens to the underside of the flexible wall area 12, into the recess 10 of the capping part 1. The pour spout 16 has, according to the depicted embodiment, a diameter which corresponds substantially to the width of the flexible wall area 12 so that those portions of the flexible wall area 12 where the pour spout 16 is immediately adjacent the sealing apparatus 11 and the floor wall 9 of the capping part 1 are reduced to a film, or thin, hinge-like configuration. The invention is however not limited to such a configuration. It is quite possible that the cross-sectional measurement of the pour spout 16 can be substantially smaller than the width dimension of the flexible wall area 12.

The pour spout 16 extends substantially parallel to the middle axis of the mouth opening 5 in the closed position of the sealing apparatus 11 shown in FIG. 2a. Other orientations of the pour spout 16 are also possible.

Because the pour spout 16 is formed on the relatively thin, or thickness-reduced, flexible wall area 12, it automatically makes the movement therewith from one end position to the other. In particular, the pour spout 16 thereby swings, or rotates, out of the FIG. 2*a* orientation, laterally and outwardly, through an angle corresponding to the previously described angle $\alpha$. In the slanted, or angled position of the pour spout 16 the bore 17 is in communication with the interior of the container 2 so that the contents of the container 2 can be comfortably poured out, in the manner of a watering can.

The movement of the sealing apparatus 11 between the end positions is brought about by application of an external force. Without this force the sealing apparatus 11 maintains whatever end position it is in because of the over-center manner in which the flexible wall area 12 snaps toward the respective end positions. To apply the force, the sealing apparatus 11 can have a handy, appropriately-shaped hand manipulation area 15 which can be engaged by a finger, or fingers, of a hand of an operating person in order to pull the sealing apparatus 11 upwardly, or push it downwardly.

It should be noted that the above described embodiment of the invention not only makes possible a movement of the sealing apparatus 11 in the direction of the middle axis of the mouth opening 5. Additionally a slanted position of the sealing apparatus 11 can be brought about which also results in the opening of the mouth opening 5 of the container 2. The slanted position of the sealing apparatus 11 is brought about when a force with a side component is applied to the hand manipulation area 15 so that a part of the surrounding flexible wall area 12 remains in the downward inverted position while another part thereof, which carries the pour spout 16, achieves an upwardly inverted position, corresponding to the slanted position of the sealing apparatus 11, so that the sealing cone 13 is moved out of a sealing engagement with the mouth opening 5 (that is, the circumferential wall forming the opening) and a swinging, or rotating of the pour spout 16 is brought about.

Figure 3:
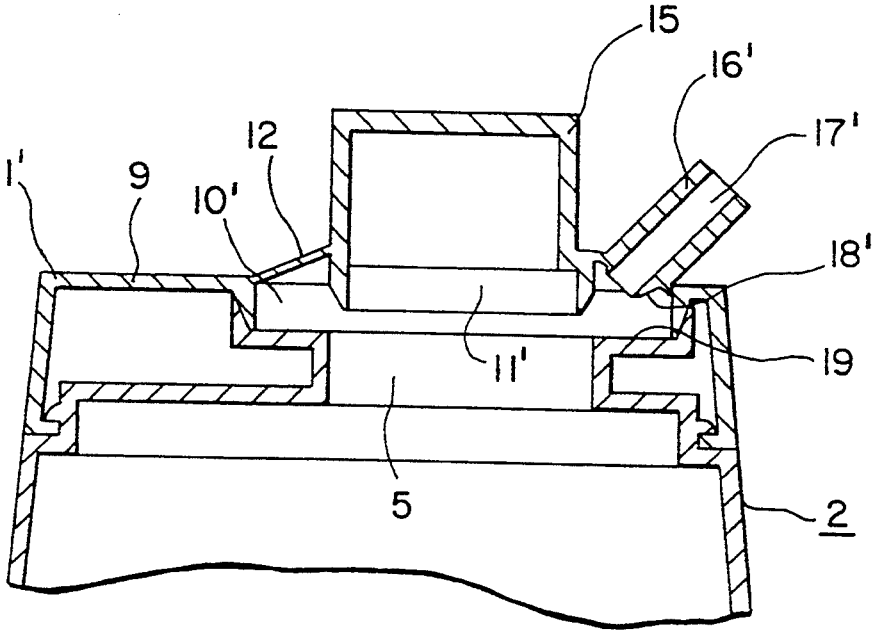
FIG. 3 is a cross-sectional view similar to FIG. 2*b* of a modification of the 1. embodiment of the invention.

FIG. 3 shows a modification of the previously described first embodiment of the invention. The modification concerns a pour spout 16' having a sealing lip 18' surrounding an inner end of the pour-spout's bore, in the recess 10' of the capping part 1, which, upon inversion of the sealing apparatus 11 into the closed position (see FIG. **2*b*), comes into contact with a shoulder sealing surface 19 of the extended wall area 7 of the container 1 so that an entrance end of the bore 17** has additional sealing.

Figure 4:
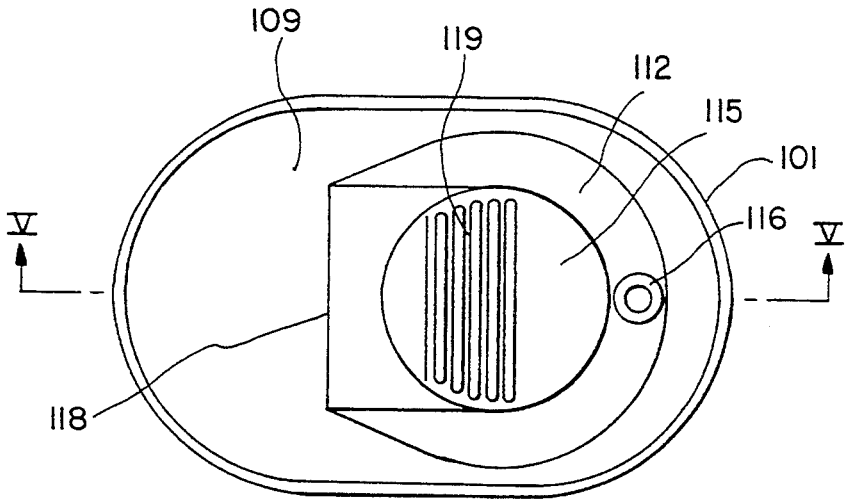
FIG. 4 is a top plan view of a closure according to a second embodiment of this invention.
Figure 5A:
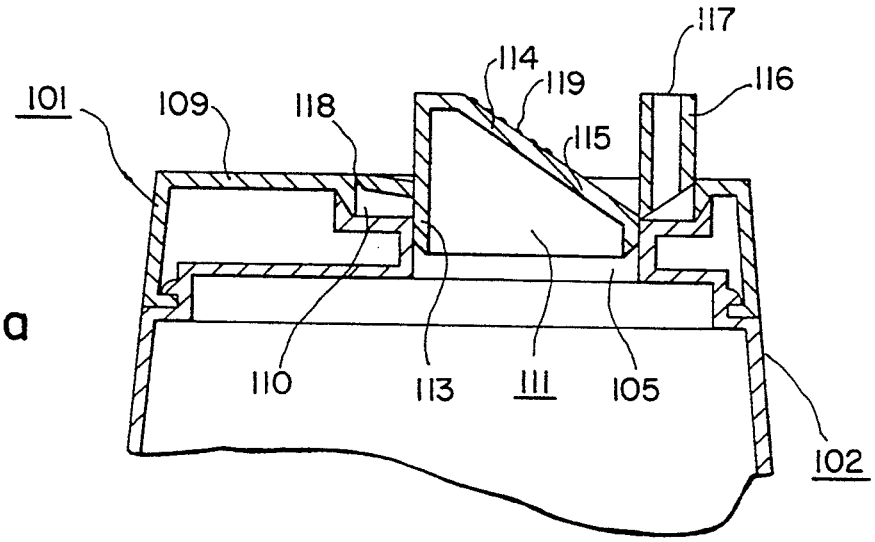
FIGS. 5*a* and 5*b* are cross-sectional views taken on line V—V in FIG. 4, respectively representing the closure in a closed position and an open position, with only a segment of a container being shown.
Figure 5B:
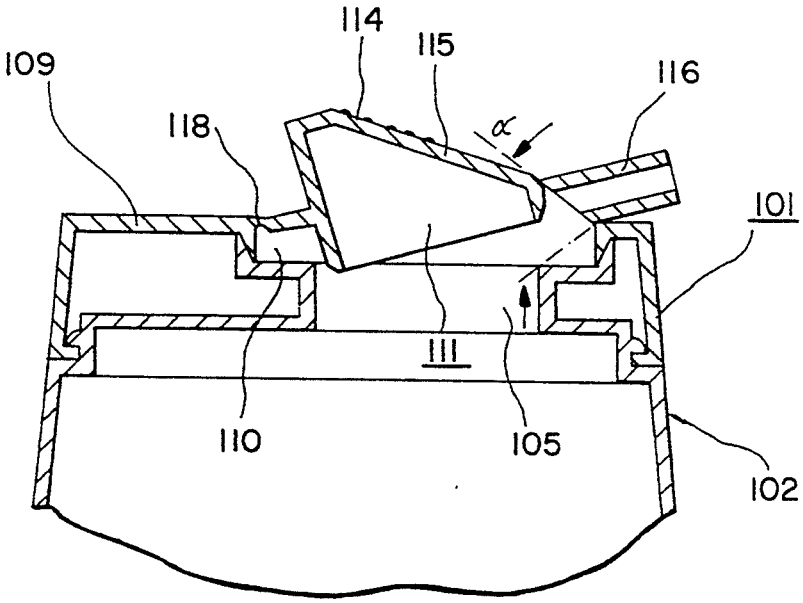

FIGS. 4, **5*a* and 5*b* depict a second embodiment of the invention. This embodiment differs from the first embodiment substantially in that a sealing apparatus 111, with a sealing cylinder or cone 113, is not completely connected with the floor wall 109 of the capping part 101 by a flexible, relatively-thin wall area 112 as for the wall area 12 of the first embodiment, but rather it is so connected only along a first peripheral portion thereof. A remaining second peripheral portion of the sealing apparatus 111 is however joined to the floor wall 109 by a straight hinge joint 118 in the form of, for example, a film hinge. The sealing apparatus 111 can, therefore, swing, or pivot, about the hinge joint 118 between end positions. During these swings, the flexible wall area 112 experiences a movement between a downwardly inverted position shown in FIG. 5*a* in which the sealing cone 113 is in sealing engagement with the mouth opening 105 of the container 102, and an upwardly inverted position shown in FIG. 5*b* in which the sealing cone 113 is out of engagement with the mouth opening 105 so that communication between the interior of the container and the bore 117** of the pour spout is established.

It should be further noted that in the second embodiment of the invention a base, or main, wall 114 of the sealing cone 113 is formed as a hand manipulation area so that the base wall, by means of an appropriate extension of the sealing cone 113, lies above the floor wall 109 of the capping part 100 with knurls provided on a slanted area 115 thereof. A force can be applied to the slanted area 115 of the base wall 114 by a finger of a hand in order to swing the sealing apparatus 111 about the hinge joint 118.

It should be further noted that, when desired, an embodiment of the pour spout 116 with a sealing lip similar to that of FIG. 3 can be provided. With regard to further details, reference should be made to the first embodiment.

Figure 6:
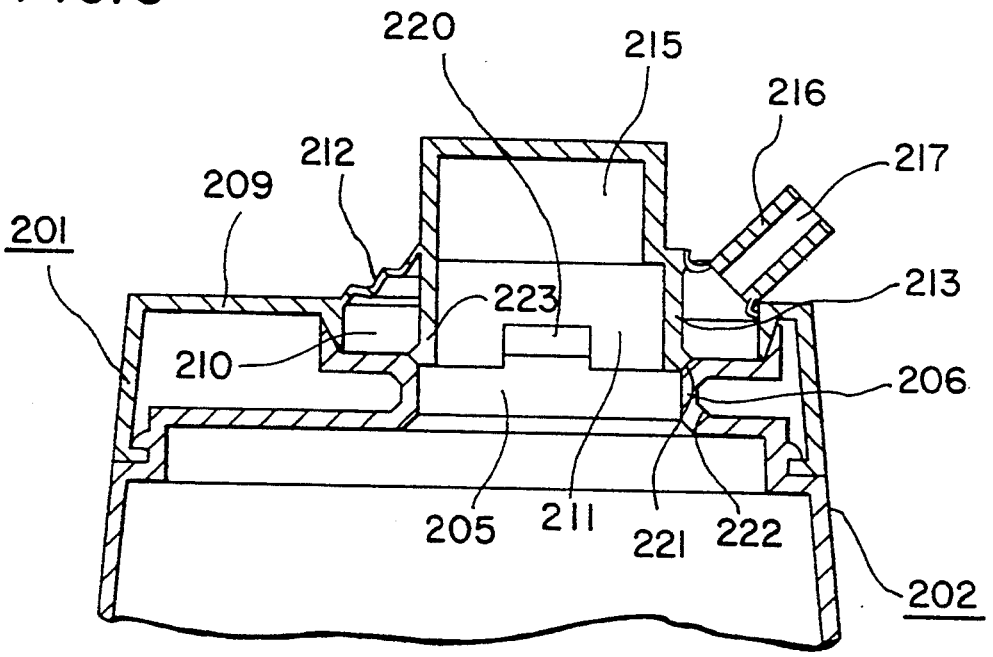
FIG. 6 is a cross-sectional view similar to FIG. 2*a* of a closure according to a third embodiment of the invention with a sealing element thereof being in an open position.

In FIG. 6 a closure according to a third embodiment of the invention is depicted. This embodiment differs from the first embodiment in that a flexible, relatively thinner, or thickness-reduced, wall area 212 has a bellows-like form so that return forces come about which try to return the wall area 212 to its beginning position (not shown in FIG. 6) when no outside force is applied to the sealing apparatus 211. In the beginning position the flexible wall area is substantially received in the recess 210 of the capping part 201 while when it is in an open position it extends out of the recess 210 and thereby bellows-forming corrugations of the wall area 212 are extended.

In order to prevent a springing return of the sealing apparatus 211 to the beginning position, a device is provided which brings about a snap-like arresting of the sealing apparatus 211 in the open and the closed positions. Although other similar devices could be provided, a supporting protrusion 221 is provided for this purposes at a free, outer, end of the sealing element 213 which engages the mouth opening 205 and which, in the closed position, can engage a slanted surface 222 at the container end of a flange-like circumferential wall 206. On the other hand, if the supporting protrusion 221 engages a slanted surface 223 on the end of the flange-like circumferential wall 206 facing away from the container, which is the case when the sealing apparatus 211 is moved to the open position, the supporting protrusion's contact with the slanted surface 223 counteracts the return force of the bellows-like wall area 212 and thereby holds the sealing apparatus 211 in the open position.

It should be further noted that in the open position the bore 217 of the pour spout 216 is in communication with the interior of the container via a notch 220 in the sealing cone 213. In the closed position of the sealing cone 213, the notch 220 is covered by the flange-like circumferential wall 206. With regard to further details of the third embodiment, reference can be made to the first embodiment.

Figure 7:
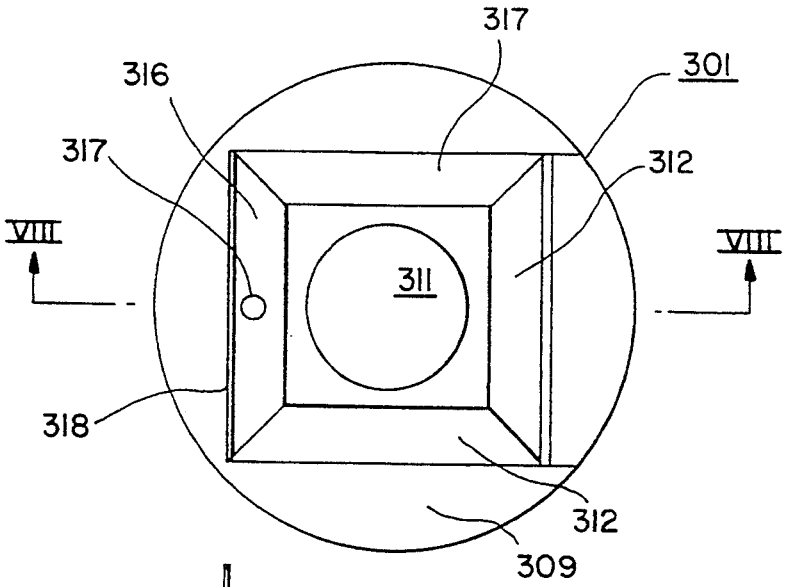
FIG. 7 is a top plan view of a closure according to a fourth embodiment of the invention.
Figure 8A:
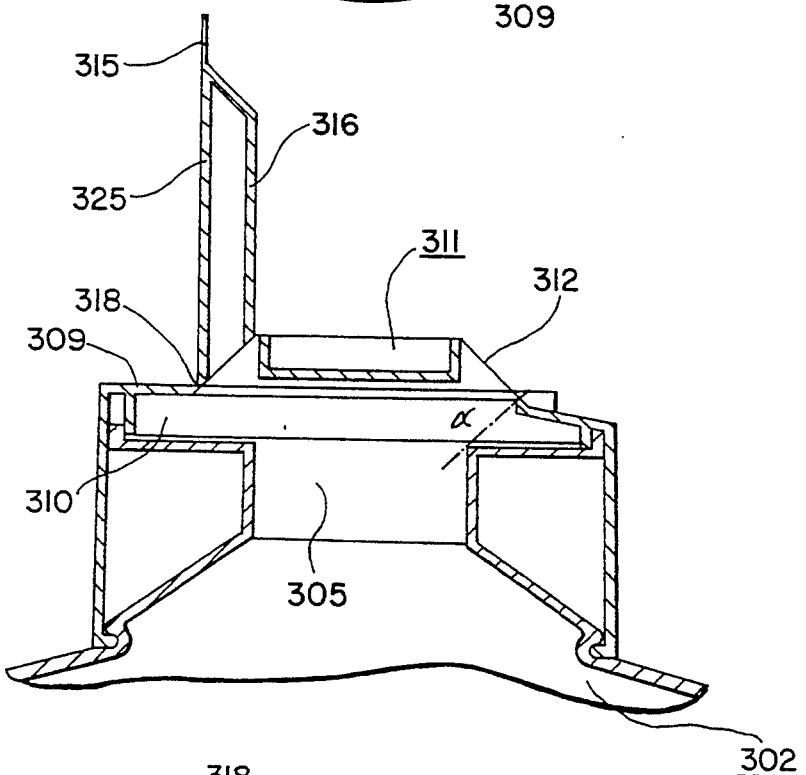
FIGS. 8*a* and 8*b* are cross-sectional views taken on line VIII—VIII in FIG. 7 respectively representing the closure in an open position and a closed position, with a segment of a container being shown.
Figure 8B:
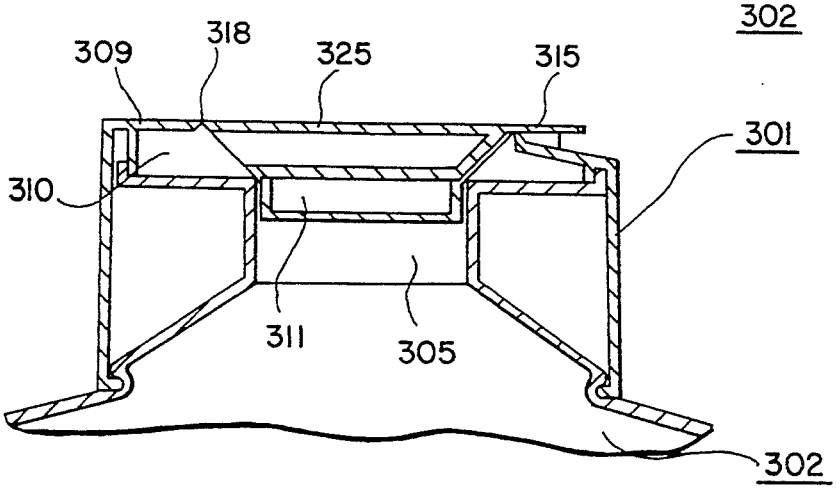

FIGS. 7, **8*a* and 8*b* depict a fourth embodiment of the invention. A feature of the fourth embodiment is that a pour spout 316, in an open position of the sealing apparatus 311 as depicted in FIG. 8*a*, is oriented in a direction of a middle axis of a mouth opening 305 of the container 302. While in a closed position it is received in a recess 310 of a capping part 301 according to FIG. 8*b*. This is accomplished by a substantially horizontal forming, or attachment, of the pour spout 316 on a flexible wall area 312**, which otherwise can be shaped or formed similar to the second embodiment of the invention.

The pour spout 316 is further on the underside of a flat, or platform-shaped, wall 325 which is joined by a hinge joint 318 with a floor wall 309 of the capping part 301 and can so correspond to a general configuration of a recess 310 that in the closed position of the sealing apparatus 311 the recess 310 is covered at its top in order to create a smooth upper side of the closure which provides benefits both in function and in providing an advertising surface. A tongue 315 can be formed on the platform shaped wall 325 which serves as a hand manipulation area to swing the pour spout 316 about the hinge joint 318, whereby the sealing apparatus 311 is automatically moved between the closed and open positions. The platform shaped wall 325 can have a width corresponding to an edge of a square formed by corners of the relatively thin wall area 312.

Figure 9:
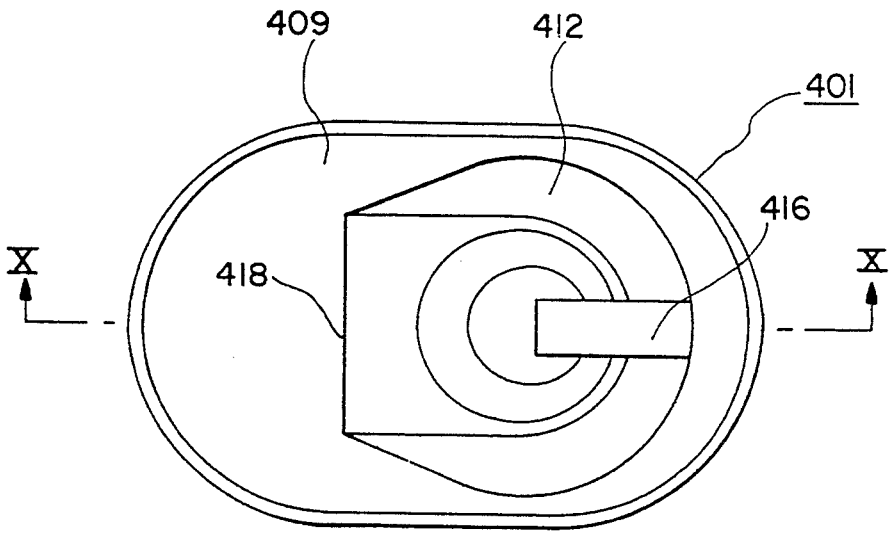
FIG. 9 is a top plan view of a closure according to a fifth embodiment of the invention.
Figure 10A:
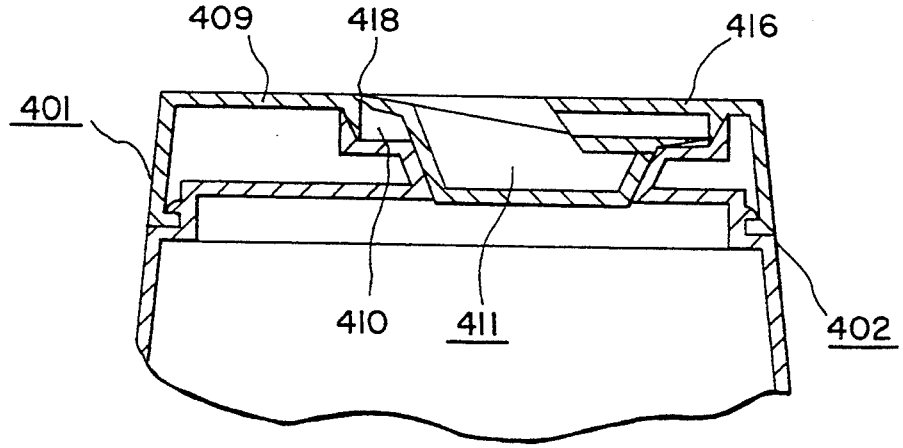
FIGS. 10*a* and 10*b* are cross-sectional views taken on line X—X in FIG. 9 which respectively represent the closure of FIG. 9 in a closed position and an opened position, and with a segment of a container being shown.
Figure 10B:
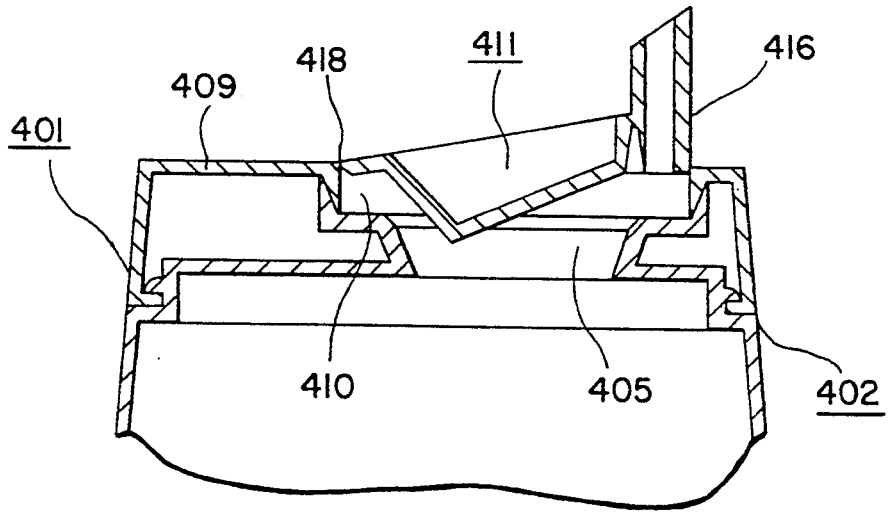

FIGS. 9, **10*a* and 10*b* depict a fifth embodiment of the invention. This embodiment is based substantially on the same concept as are the previously described four embodiments in that a pour spout 416 is so formed on a flexible, relatively-thin, wall area 412 that it, in a closed position of a sealing apparatus 411, is received in a recess 410 of a capping part 401, while it, in an open position, is oriented in a direction of a middle axis of a mouth opening 405 of a container 402. The pour spout 416 serves further as a hand manipulation area to swing the sealing apparatus 411 about a hinge joint 418 between the closed and open positions. Contrary to the device of the fourth embodiment, the flexible wall area 412 extends, arc-like, on both sides of the hinge joint 418**, similar to the second embodiment of the invention.

The invention is described using preferred embodiments. However, it is not so limited. In this regard, instead of a sealing apparatus with a sealing cone, or cylinder, for engaging a mouth opening of a container, also a sealing element can be provided that has a facing surface of a flange-like circumferential wall which surrounds the mouth opening to move into a sealing relationship therewith. Further, if desired, the pour spout, instead of being mounted on a flexible relatively thinner wall area, can also be provided on any other appropriate position of the capping part so that it is not influenced by movement of the flexible wall area, but rather so that it holds its position. It should further be understood that the mouth opening does not have to be a part of a container, rather, it can also be part of a removable cap which closes an open container end.

While the invention has been particularly shown and described with reference to a preferred embodiment, it will be understood by those of ordinary skill in the art that various changes in form and detail may be made therein without departing from the spirit and scope of the invention.

The embodiments of the invention in which an exclusive property or privilege are claimed are defined as follows:

1. Integrally formed closure for a container which is adapted to be operated by one hand including:

a) a capping part for attaching the closure to the container to cover a mouth thereof, and having an essentially rigid structure, b) a sealing means for, under the influence of an external force, being moved into and out of a sealing relationship with a wall defining a mouth opening for closing and opening said mouth and for being connected along at least a portion of its periphery to the capping part by means of a flexible, thickness-reduced wall portion adapted to be inverted between open and closed end positions which correspond to open and closed positions of the sealing means, wherein the flexible thickness-reduced wall portion along at least a portion of its peripheral length in the open end position thereof extends beyond an outer contour of the capping part, and c) a pour element connected to the capping part and having a throughbore which is in communication with the interior of the container when the sealing means is in the open end position, said sealing means further including a hand manipulation portion for applying external force to the sealing means, said hand manipulation portion extending at least partially beyond the outer contour of the capping part in both the open and closed positions of the sealing means, and being moved to an open position when a force transverse to a longitudinal axis of the container passing through the mouth is applied thereto, and wherein the flexible thickness-reduced wall portion forms an angle in a range of between 30° to approximately 90° when it moves between said end positions.

2. Closure according to claim 1 wherein the flexible thickness-reduced wall portion extends completely along the periphery of the sealing means.

3. Closure according to claim 1 wherein the flexible thickness-reduced wall portion extends between opposite sides of a film hinge by which the sealing means is connected to the capping part.

4. Closure according to claim 1 wherein the pour element is supported by the flexible thickness-reduced wall portion whereby the pour element is swingable between end positions corresponding to the end positions of the flexible thickness-reduced wall portion.

5. Closure according to claim 4 wherein an inner end of the pour element, in a position corresponding to a closed end position of the sealing means is in sealing engagement with a sealing surface.

6. Closure as in claim 4 wherein the pour element, at least in the closed position of the sealing means, is oriented substantially in a direction of a middle axis of the mouth opening of the container.

7. Closure as in claim 4 wherein the pour element is received within the capping part in the closed position of the sealing means.

* * * * *